US011698038B2

(12) United States Patent
Berg et al.

(10) Patent No.: US 11,698,038 B2
(45) Date of Patent: Jul. 11, 2023

(54) SYSTEM AND METHOD FOR OPERATING A FUEL SUPPLY PUMP OF A VEHICLE

(71) Applicant: Scania CV AB, Södertälje (SE)

(72) Inventors: Adam Berg, Lidingö (SE); Kim Kylström, Tullinge (SE); Peter Gustafsson, Nyköping (SE)

(73) Assignee: Scania CV AB, Södertälje (SE)

( * ) Notice: Subject to any disclaimer, the term of this patent is extended or adjusted under 35 U.S.C. 154(b) by 0 days.

(21) Appl. No.: 17/777,133

(22) PCT Filed: Nov. 23, 2020

(86) PCT No.: PCT/SE2020/051112

§ 371 (c)(1),
(2) Date: May 16, 2022

(87) PCT Pub. No.: WO2021/107837

PCT Pub. Date: Jun. 3, 2021

(65) Prior Publication Data

US 2022/0389880 A1 Dec. 8, 2022

(30) Foreign Application Priority Data

Nov. 29, 2019 (SE) ..... 1951369-6

(51) Int. Cl.
*F02D 41/02* (2006.01)
*F02D 1/02* (2006.01)
(Continued)

(52) U.S. Cl.
CPC ..... *F02D 41/023* (2013.01); *F02D 1/02* (2013.01); *F02D 41/045* (2013.01); *F02D 41/12* (2013.01);
(Continued)

(58) Field of Classification Search
CPC .... B60W 30/19; F02D 41/023; F02D 41/045; F02D 41/12; F02D 41/126; F02D 2200/0614; F02D 2250/28
(Continued)

(56) References Cited

U.S. PATENT DOCUMENTS 4,800,859 A 1/1989 Sagisaka et al.
6,321,722 B1 * 11/2001 Nakano ..... F02D 41/023 477/173
(Continued)

FOREIGN PATENT DOCUMENTS

EP 2441943 A2 4/2012
JP S60147564 A 8/1985
(Continued)

OTHER PUBLICATIONS

Scania CV AB, International Patent Application No. PCT/SE2020/051112, International Preliminary Report on Patentability, dated May 17, 2022.
(Continued)

*Primary Examiner* — Erick R Solis
(74) *Attorney, Agent, or Firm* — Moore & Van Allen PLLC; W. Kevin Ransom

(57) ABSTRACT

The invention relates to a method for operating a fuel supply pump of a vehicle, the vehicle comprising a combustion engine system and a gearbox, the method comprising the steps of: determining one or more operational values of at least one operational parameter of the combustion engine system; determining a reduction of a fuel provision rate to the combustion engine system; determining whether a gear step change of the gearbox is at hand, on the basis of the determined one or more operational values of the at least one operational parameter; and in case a gear step change of the
(Continued)

gearbox is at hand, controlling operation of the fuel supply pump so as to maintain fuel supply pump speed.

14 Claims, 4 Drawing Sheets

(51) Int. Cl.
*F02D 41/14* (2006.01)
*F02D 41/12* (2006.01)
*F02D 41/04* (2006.01)

(52) U.S. Cl.
CPC ..... *F02D 41/126* (2013.01); *F02D 41/1454* (2013.01); *F02D 2200/0614* (2013.01); *F02D 2200/50* (2013.01)

(58) Field of Classification Search
USPC ..... 123/325, 326, 446, 458, 512; 701/102; 477/47, 109
See application file for complete search history.

(56) References Cited

U.S. PATENT DOCUMENTS

2014/0373809 A1 12/2014 Kawamoto et al.
2020/0238994 A1* 7/2020 Yanagisawa ..... B60W 10/30

FOREIGN PATENT DOCUMENTS

WO 03023232 A2 3/2003
WO 2014189444 A1 11/2014

OTHER PUBLICATIONS

Scania CV AB, International Patent Application No. PCT/SE2020/051112, International Search Report, dated Jan. 18, 2021.
Scania CV AB, International Patent Application No. PCT/SE2020/051112, Written Opinion, dated Jan. 18, 2021.
Scania CV AB, Swedish Patent Application No. 1951369-6, Office Action, dated May 25, 2020.

* cited by examiner

SYSTEM AND METHOD FOR OPERATING A FUEL SUPPLY PUMP OF A VEHICLE

CROSS-REFERENCE TO RELATED APPLICATIONS

This application is a National Stage Patent Application (filed under 35 § U.S.C. 371) of PCT/SE2020/051112, filed Nov. 23, 2020, of the same title, which, in turn claims priority to Swedish Patent Application No. 1951369-6 filed Nov. 29, 2019, of the same title; the contents of each of which are hereby incorporated by reference.

FIELD OF THE INVENTION

The present invention relates to a method for operating a fuel supply pump of a vehicle. In particular the present invention relates to controlling a fuel supply pump at a low pressure side of a fuel provision system of a combustion engine. The invention relates also to a computer program product comprising program code for a computer for implementing a method according to the invention. It relates also to a system operating a fuel supply pump of a vehicle and a vehicle equipped with the system.

BACKGROUND OF THE INVENTION

Motor vehicles being arranged to be propelled by means of an internal combustion engine are provided with a fuel provision system. According to one variant, a low-pressure fuel circuit of the fuel provision system comprises a feeder pump being arranged to provide fuel to a high pressure pump of the internal combustion engine.

Some drawbacks have been identified regarding the low-pressure fuel circuit. One of them is appearance of a reduction of fuel pressure in the low-pressure fuel circuit of the fuel provision system during gear shifting. This phenomenon occurs due to that fact that the existing regulation strategy is controlling the feeder pump to reduce its speed when the injected amount of fuel to the engine is reduced, which may happen during dragging of the engine, e.g. when driving downhill, but also during gear shifting. The problem is though that the gear shifting sequence is relatively fast and the feeder pump hereby is not always able to increase its speed fast enough to reach a nominal fuel feed pressure after the shifting is performed.

The speed of the feeder feed pump is today regulated on the basis of a prevailing fuel pressure downstream of the feeder pump. The feeder pump speed is controlled in such a way that a constant fuel feed pressure is achieved. There is also an input regarding the amount of fuel injected to the engine. The reason for this is that there is a desire to reduce the feeder pump speed during dragging of the engine. However, during gear shifting the injected amount of fuel is also reduced (e.g. to a zero level), but only for a relatively short amount of time. Hereby the feeder pump is arranged to reduce pump speed, but since the time window for a gear shifting is so short, the feeder pump is not able to increase its speed fast enough again when the shifting sequence has been performed. This may cause discomfort for an operator of the vehicle.

Another issue is that pressure spikes in the fuel provision system occurs during the gear shifting sequence. Since there are so many gear shifting sequences during the life of a truck this can give arise to fatigue problems of the fuel pipes.

WO2014189444A1 discloses a method for controlling a low-pressure circuit in fuel system of a vehicle. Hereby controlling of a fuel pump in low-pressure circuit is based on a future working point that is determined based on road ahead information.

SUMMARY OF THE INVENTION

An object of the present invention is to propose a novel and advantageous method for operating a fuel supply pump of a vehicle.

Another object of the invention is to propose a novel and advantageous system and a novel and advantageous computer program for operating a fuel supply pump of a vehicle.

Another object of the present invention is to propose a novel and advantageous method providing a more comfortable operation of a vehicle.

Another object of the invention is to propose a novel and advantageous system and a novel and advantageous computer program providing a more comfortable operation of a vehicle.

Yet another object of the invention is to propose a method, a system and a computer program achieving a fully automated and user-friendly operation of a fuel supply pump of a vehicle.

Yet another object of the invention is to propose a method, a system and a computer program for achieving fuel supply operation involving low wear of components of the fuel supply system.

Yet another object of the invention is to propose an alternative method, an alternative system and an alternative computer program operating a fuel supply pump of a vehicle.

Some of these objects are achieved with a method according to claim 1. Other objects are achieved with a system in accordance with what is depicted herein. Advantageous embodiments are depicted in the dependent claims. The same advantages of method steps of the proposed method hold true for corresponding means of the proposed system.

According to an aspect of the disclosure there is provided a method for operating a fuel supply pump of a vehicle, the vehicle comprising a combustion engine system and a gearbox, the method comprising the steps of:

determining values of at least one operational parameter of the combustion engine system;

determining a reduction of a fuel provision rate to the combustion engine system;

determining whether a gear step change of the gearbox is at hand, on the basis of the thus determined values of the at least one operational parameter; and in case a gear step change of the gearbox is at hand, controlling operation of the fuel supply pump so as to maintain fuel supply pump speed.

Hereby a prevailing fuel supply pump speed may be maintained at a current level during a gear shifting process of the gearbox. This advantageously provides a more comfortable propulsion of the vehicle since a stable operation without great variations of fuel supply is achieved. This also provides a fuel supply system which is introducing less wear of components of the fuel supply system.

Any one of the steps of the method for operating a fuel supply pump of a vehicle may be performed continuously or intermittently.

By identifying if a gear shifting process of the gearbox is at hand when the injected fuel amount rate is decreased it can be concluded that the vehicle is not dragging. The gear shift process is a relatively short process and advantageously the fuel supply pump rate is not reduced from a current level if a gear step change of the gearbox is at hand.

The fuel supply pump is arranged in a low-pressure circuit of a fuel supply system. The fuel supply pump may be a feeder pump being arranged to provide fuel to a high pressure pump of a combustion engine.

Advantageously the proposed method introduces less vehicle vibrations and reduced vehicle noise emissions during a gear step change.

The method may comprise the step of:

in case a gear step change of the gearbox is not at hand, allowing a change of fuel supply pump speed. The fuel supply pump speed may thus be reduced in case fuel provision to the combustion engine system is reduced. This is advantageous e.g. in an engine state of dragging. Hereby a fuel saving and cost-effective method is provided.

The method may comprise the steps of:

determining a boost pressure of the combustion engine system; and determining that a gear step change of the gearbox is at hand if the boost pressure is unchanged over time. Hereby a reliable and robust way of determining if a gear step change of the gearbox is at hand is provided. Hereby an automated and cost-effective function for controlling operation of the fuel supply pump is achieved. The step of determining a boost pressure of the combustion engine system may be performed continuously or intermittently.

The method may comprise the steps of:

determining a boost pressure of the combustion engine system; and determining that a gear step change of the gearbox is not at hand if the boost pressure is changed more than to a predetermined extent. Hereby a reliable and robust way of determining if a gear step change of the gearbox is not at hand is provided. Hereby an automated and cost-effective function for controlling operation of the fuel supply pump is achieved. The predetermined extent may be a predetermined extent, e.g. 5%, 10% or 25% of a prevailing level. The step of determining a boost pressure of the combustion engine system may be performed continuously or intermittently.

The method may comprise the steps of:

determining a Lambda-value of the combustion engine system; and determining that a gear step change of the gearbox is at hand if the Lambda-value is unchanged over time. Hereby a reliable and robust way of determining if a gear step change of the gearbox is at hand is provided. Hereby an automated and cost-effective function for controlling operation of the fuel supply pump is achieved. The step of determining a Lambda-value of the combustion engine system may be performed continuously or intermittently.

The method may comprise the steps of:

determining a Lambda-value of the combustion engine system; and determining that a gear step change of the gearbox is not at hand if the Lambda-value is changed more than to a predetermined extent. Hereby a reliable and robust way of determining if a gear step change of the gearbox is not at hand is provided. Hereby an automated and cost-effective function for controlling operation of the fuel supply pump is achieved. The predetermined extent may be a predetermined extent, e.g. 5%, 10% or 25% of a prevailing level. The step of determining a Lambda-value of the combustion engine system may be performed continuously or intermittently.

According to one embodiment it is determined that a gear-step change of the gearbox is at hand if the boost pressure has been determined to be unchanged. According to one embodiment it is determined that a gear-step change of the gearbox is not at hand if the boost pressure has been determined to have changed. According to one embodiment it is determined that a gear-step change of the gearbox is at hand if the Lambda-value has been determined to be unchanged. According to one embodiment it is determined that a gear-step change of the gearbox is not at hand if the Lambda-value has been determined to have changed.

According to one embodiment it is determined that a gear-step change of the gearbox is at hand if both the Lambda-value and the boost pressure have been determined to be unchanged. According to one embodiment it is determined that a gear-step change of the gearbox is not at hand if both the Lambda-value and the boost pressure have been determined to have changed.

According to one embodiment it is determined that a gear-step change of the gearbox is at hand if it is detected that a clutch unit of the transmission of the vehicle is disengaged. This may be performed by any suitable means. According to one embodiment it is determined that a gear-step change of the gearbox is not at hand if it is detected that a clutch unit of the transmission of the vehicle is engaged. According to one embodiment it is determined that a gear-step change of the gearbox is at hand if it is detected that a gear-step change of the gearbox is activated/initiated. This may be performed by any suitable means. According to one embodiment it is determined that a gear-step change of the gearbox is not at hand if it is detected that a gear-step change of the gearbox is not activated/initiated.

According to one embodiment it is determined that a gear-step change of the gearbox is at hand if it is detected that a significant change of engine torque is request. This may be performed by any suitable means. According to one embodiment it is determined that a gear-step change of the gearbox is not at hand if it is detected that a significant change of engine torque is not request.

According to an aspect of the disclosure there is provided a system for operating a fuel supply pump of a vehicle, the vehicle comprising a combustion engine system and a gearbox, the system comprises:

means being arranged for determining values of at least one operational parameter of the combustion engine system;

means being arranged for determining a reduction of a fuel provision rate to the combustion engine system;

means being arranged for determining whether a gear step change of the gearbox is at hand, on the basis of the thus determined values of the at least one operational parameter; and means being arranged for, in case a gear step change of the gearbox is at hand, controlling operation of the fuel supply pump so as to maintain fuel supply pump speed.

The means being arranged for determining values of at least one operational parameter may comprise any one of one or more electronic control arrangements, a boost pressure sensor and a Lambda-sensor configuration.

The means being arranged for determining a change of fuel provision to the combustion engine system may comprise one of one or more electronic control arrangements.

The means being arranged for determining whether a gear step change of the gearbox is at hand may comprise one of one or more electronic control arrangements.

The means being arranged for controlling operation of the fuel supply pump may comprise one of one or more electronic control arrangements.

The system may comprise means being arranged for, in case a gear step change of the gearbox is not at hand, allowing a change of fuel supply pump speed. The means being arranged for allowing a change of fuel supply pump speed may comprise one of one or more electronic control arrangements.

The system may comprise:

means being arranged for determining a boost pressure of the combustion engine system; and means being arranged for determining that a gear step change of the gearbox is at hand if the boost pressure is unchanged over time.

The means being arranged for determining a boost pressure of the combustion engine system may comprise one or more electronic control arrangements and a boost pressure sensor. The means being arranged for determining that a gear step change of the gearbox is at hand may comprise one or more electronic control arrangements. The means being arranged for determining a boost pressure may be arranged to determine the boost pressure continuously or intermittently.

The system may comprise:

means being arranged for determining a boost pressure of the combustion engine system; and means being arranged for determining that a gear step change of the gearbox is not at hand if the boost pressure is changed more than to a predetermined extent.

The means being arranged for determining a boost pressure of the combustion engine system may comprise one or more electronic control arrangements and a boost pressure sensor. The means being arranged for determining that a gear step change of the gearbox is not at hand may comprise one or more electronic control arrangements. The means being arranged for determining a boost pressure may be arranged to determine the boost pressure continuously or intermittently.

The system may comprise:

means being arranged for determining a Lambda-value of the combustion engine system; and means being arranged for determining that a gear step change of the gearbox is at hand if the Lambda-value is unchanged over time.

The means being arranged for determining a Lambda-value of the combustion engine system may comprise one or more electronic control arrangements and a Lambda-sensor configuration. The means being arranged for determining that a gear step change of the gearbox is at hand may comprise one or more electronic control arrangements. The means being arranged for determining a Lambda-value may be arranged to determine the Lambda-value continuously or intermittently.

The system may comprise:

means being arranged for determining a Lambda value of the combustion engine system; and means being arranged for determining that a gear step change of the gearbox is not at hand if the Lambda-value is changed more than to a predetermined extent.

The means being arranged for determining a Lambda-value of the combustion engine system may comprise one or more electronic control arrangements and a Lambda-sensor configuration. The means being arranged for determining that a gear step change of the gearbox is not at hand may comprise one or more electronic control arrangements. The means being arranged for determining a Lambda-value may be arranged to determine the Lambda-value continuously or intermittently.

According to an aspect of the invention there is provided a vehicle comprising a system according to what is presented herein.

According to an aspect of the invention there is provided a computer program product comprising instructions which, when the program is executed by a computer, cause the computer to carry out any one of the steps of the method depicted herein.

According to an aspect of the invention there is provided a computer-readable storage medium comprising instructions which, when executed by a computer, cause the computer to carry out any one of the steps of the method depicted herein.

According to an aspect of the invention there is provided a computer program product comprising instructions which, when the program is executed by an electronic control arrangement, cause the electronic control arrangement to carry out any one of the steps of the method depicted herein.

According to an aspect of the invention there is provided a computer-readable storage medium comprising instructions which, when executed by an electronic control arrangement, cause the electronic control arrangement to carry out any one of the steps of the method depicted herein.

According to an aspect of the invention there is provided a computer program for operating a fuel supply pump of a vehicle, wherein the computer program comprises program code for causing an electronic control arrangement or a computer connected to the electronic control arrangement to perform any one of the method steps depicted herein, when run on the electronic control arrangement or the computer.

According to an aspect of the invention there is provided a computer program for operating a fuel supply pump of a vehicle, wherein the computer program comprises program code stored on a computer-readable medium for causing an electronic control arrangement or a computer connected to the electronic control arrangement to perform any one of the method steps depicted herein.

According to an aspect of the invention there is provided a computer program for operating a fuel supply pump of a vehicle, wherein the computer program comprises program code stored on a computer-readable medium for causing an electronic control arrangement or a computer connected to the electronic control arrangement to perform any one of the method steps depicted herein, when run on the electronic control arrangement or the computer.

According to an aspect of the invention there is provided a computer program product containing a program code stored on a computer-readable medium for performing any one of the method steps depicted herein, when the computer program is run on an electronic control arrangement or a computer connected to the electronic control arrangement.

According to an aspect of the invention there is provided a computer program product containing a program code stored non-volatile on a computer-readable medium for performing any one of the method steps depicted herein, when the computer program is run on an electronic control arrangement or a computer connected to the electronic control arrangement.

Further objects, advantages and novel features of the present invention will become apparent to one skilled in the art from the following details, and also by putting the invention into practice. Whereas the invention is described below, it should be noted that it is not confined to the specific details described. One skilled in the art having access to the teachings herein will recognise further applications, modifications and incorporations in other fields, which are within the scope of the invention.

BRIEF DESCRIPTION OF THE DRAWINGS

For fuller understanding of embodiments of the present invention and its further objects and advantages, the detailed description set out below should be read in conjunction with the accompanying drawings, in which the same reference notations denote similar items in the various diagrams, and in which.

DETAILED DESCRIPTION

Figure 1:
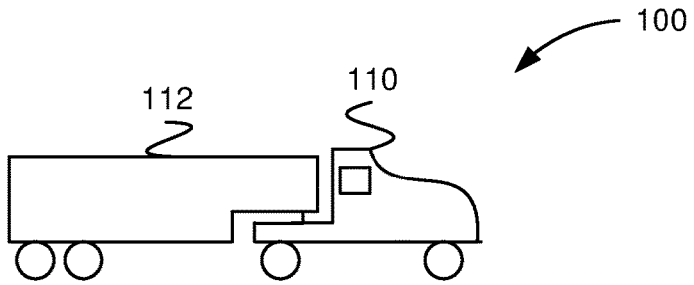
FIG. 1 schematically illustrates a vehicle according to an embodiment of the invention.

FIG. 1 depicts a side view of a vehicle 100. The exemplified vehicle 100 comprises a tractor unit 110 and a trailer 112. The vehicle 100 may be a heavy vehicle, e.g. a truck or a bus. It may alternatively be a car. The vehicle 100 comprises a combustion engine system and transmission for propelling the vehicle. The vehicle 100 may comprise an internal combustion engine and a multi-step gearbox. The transmission may comprise a clutch being arranged to disengage the gearbox from an outgoing shaft of the combustion engine during a gear-step change of the gearbox.

The method and system are applicable to various vehicles comprising a combustion engine system and transmission for propelling the vehicle, such as e.g. a mining machine, tractor, dumper, wheel-loader, forest machine, earth mover, road construction vehicle, road planner, emergency vehicle or a tracked vehicle. The method and system disclosed herein is applicable to various stationary platforms comprising a combustion engine system and transmission for conveying torque to any application device/system.

The term "link" refers herein to a communication link which may be a physical connection such as an opto-electronic communication line, or a non-physical connection such as a wireless connection, e.g. a radio link or microwave link.

The term "system" is according to one embodiment herein defined as a system comprising only one electronic control arrangement or a number of connected electronic control arrangements. Said one electronic control arrangement or said number of connected electronic control arrangements may be arranged to perform the steps according to the method depicted herein. Herein the term "electronic control arrangement" may be synonymous with an "electronic control unit" (ECU)

The terminology used herein is for the purpose of describing particular aspects of the disclosure only, and is not intended to limit the disclosure. As used herein, the singular forms "a", "an" and "the" are intended to include the plural forms as well, unless the context clearly indicates otherwise.

In some implementations and according to some aspects of the disclosure, the functions or steps noted in the blocks can occur out of the order noted in the operational illustrations. For example, two blocks shown in succession can in fact be executed concurrently or the blocks can sometimes be executed in the reverse order, depending upon the functionality/acts involved. Also, the functions or steps noted in the blocks can according to some aspects of the disclosure be executed continuously in a loop.

It should be emphasized that the term "comprises/comprising" when used in this specification is taken to specify the presence of stated features, integers, steps, or components, but does not preclude the presence or addition of one or more other features, integers, steps, components, or groups thereof.

The term "combustion engine system" herein refers to a system comprising a combustion engine. Other components of the combustion engine system may be a turbo (boost) unit, an engine inlet passage, an engine outlet passage, etc. According to one embodiment the combustion engine system also comprises a transmission for propelling the vehicle. The transmission comprises a gearbox (not shown).

Figure 2A:
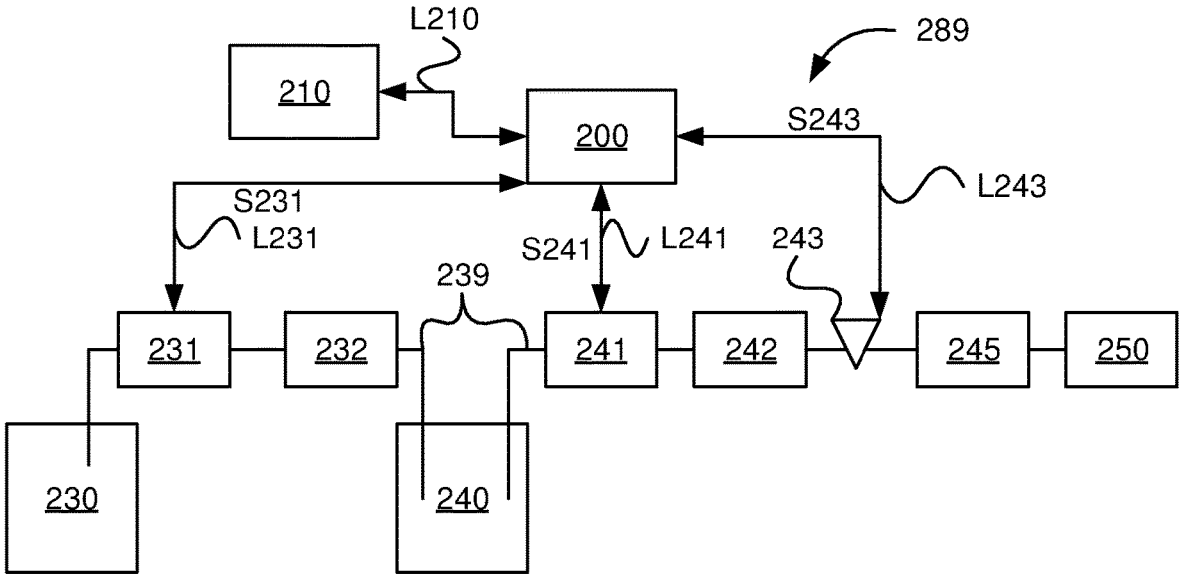
FIG. 2*a* schematically illustrates a system according to an embodiment of the invention.

FIG. 2*a* schematically illustrates a fuel supply system 289 of the vehicle 100. The system 289 is situated in the tractor unit 110.

A first fuel tank 230 is arranged to hold a fuel for provision to an engine 250 of the vehicle 100. The first fuel tank 230 may be referred to as main fuel tank. The engine 250 may be any suitable engine, such as an internal combustion engine. The engine 250 may comprise a so called Otto-engine or a diesel engine. The fuel is a fluid. The fuel may be a so-called liquid fuel. The fuel may comprise hydrocarbon fuels, various alcohols and/or bio-diesel. The fuel may be a gaseous fuel. The fuel may be a liquefied petroleum gas.

A fuel passage configuration 239 is arranged to convey the fuel from the first fuel tank 230 via a number of components for provision to the engine 250. A first electronic control arrangement 200 is arranged for communication with a first electrical fuel pump 231 via a link L231. The first electrical fuel pump 231 may be referred to as transfer pump. The first control arrangement 200 is arranged to control operation of the first electrical fuel pump 231 by means of control signals S231. The first electrical fuel pump 231 is arranged to feed the fuel through a first filter unit 232. The first filter unit 232 is arranged for water separation and to filter the fuel with regard to larger particles and contamination material.

The fuel passage configuration 239 is arranged to convey the fuel from the first fuel tank 230 to a second fuel tank 240. The second fuel tank 240 may be referred to as catch tank. The catch tank is preferably smaller than the main tank. The first electronic control arrangement 200 is arranged for communication with a second electrical fuel pump 241 via a link L241. The second electrical fuel pump 241 may be referred to as feeder pump. The first control arrangement 200 is arranged to control operation of the second electrical fuel pump 241 by means of control signals S241. The second electrical fuel pump 241 is arranged to feed the fuel through a second filter unit 242. The second filter unit 242 is arranged to filter the fuel with regard to finer particles and contamination material.

The feeder pump 241 is arranged to provide the fuel to a high pressure pump (HHP) 245. A portion of the fuel supply system 289 being arranged upstream of the high pressure pump 245 is referred to as a low pressure fuel circuitry. The high pressure pump 245 is arranged to provide fuel for controlled injection to combustion chambers of the engine 250. The first control arrangement 200 is arranged to control fuel supply to the engine 250. An injected amount of the fuel is herein denoted Qinj. The first control arrangement 200 may be adapted to control operation of the engine 250 in accordance with stored control routines.

The first electronic control arrangement 200 is arranged for communication with a fuel pressure sensor 243 via a link L243. The fuel pressure sensor 243 is arranged to measure a prevailing fuel pressure Pr of the fuel within the fuel passage configuration 239 at a position downstream of the second filter unit 242 and upstream of a the high pressure pump 245. The fuel pressure sensor 243 is arranged to send signals S243 comprising information about the determined prevailing fuel pressure Pr to the first control arrangement 200 via the link L243.

A second control arrangement 210 is arranged for communication with the first control arrangement 200 via a link L210. It may be releasably connected to the first control arrangement 200. It may be a control arrangement external to the vehicle 100. It may be adapted to perform the steps according to embodiments of the invention. It may be used to cross-load software to the first control arrangement 200, particularly software for applying the method disclosed herein. It may alternatively be arranged for communication with the first control arrangement 200 via an internal network on board the vehicle 100. It may be adapted to perform functions corresponding to those of the first control arrangement 200, such as determining whether a gear step change of a gearbox of the vehicle is at hand, on the basis of the thus determined values of the at least one operational parameter. It may be adapted to, in case a gear step change of the gearbox is at hand, controlling operation of the feeder pump 241 so as to maintain the speed Prpm of the feeder pump 241.

Figure 2B:
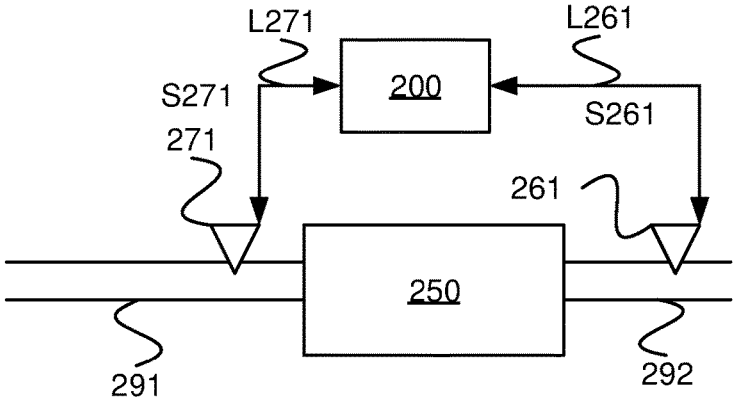
FIG. 2*b* schematically illustrates a system according to an embodiment of the invention.

FIG. 2*b* schematically illustrates a portion of a combustion engine system of the vehicle 100. The combustion engine system may comprise a turbo charger unit (not shown). The first control arrangement 200 is arranged for communication with a boost pressure sensor 271 via a link L271. The boost pressure sensor 271 is arranged to measure a prevailing boost pressure Pb in an air intake passage of the engine 250. The boost pressure sensor 271 may be arranged to continuously or intermittently measure a prevailing boost pressure Pb in an air intake passage of the engine 250 The boost pressure sensor 271 is arranged to send signals S271 comprising information about the measured prevailing boost pressure Pb to the first control arrangement 200 via the link L271.

The first control arrangement 200 is arranged for communication with a Lambda-sensor configuration 261 via a link L261. The Lambda-sensor configuration 261 is arranged to determine adequate information for determining a prevailing Lambda-value λ relating to engine operation. Here the Lambda-sensor configuration 261 is arranged in an outlet passage of the engine 250. The Lambda-sensor configuration 261 may be arranged to continuously or intermittently determine a prevailing Lambda-value λ. The Lambda-sensor configuration 261 is arranged to send signals S261 comprising the thus determined adequate information for determining the prevailing Lambda-value λ to the first control arrangement 200 via the link L261. The Lambda-value λ is known to relate to an Air Fuel Ratio (AFR).

According to one aspect of the disclosure there is provided a system for operating a fuel supply pump 241 of a vehicle 100, the vehicle comprising a combustion engine system 250 and a gearbox.

According to an example there is provided a system comprising means being arranged for determining values of at least one operational parameter of the combustion engine system 250. The means being arranged for determining values of at least one operational parameter may comprise any one of the first control arrangement 200, the second control arrangement 210, the device 500 (FIG. 5), the boost pressure sensor 271 and the Lambda-sensor configuration 261. The at least one operational parameter may be the boost pressure Pb of the combustion engine system 250 and/or the Lambda-value λ of the combustion engine system 250.

According to an example there is provided a system comprising means being arranged for determining a change of fuel provision to the combustion engine system 250. The means being arranged for determining a change of fuel provision may comprise any one of the first control arrangement 200, the second control arrangement 210 and the device 500.

According to an example there is provided a system comprising means being arranged for determining whether a gear step change of the gearbox is at hand, on the basis of the thus determined values of the at least one operational parameter. The means being arranged for determining whether a gear step change of the gearbox is at hand may comprise any one of the first control arrangement 200, the second control arrangement 210 and the device 500.

According to an example there is provided a system comprising means being arranged for, in case a gear step change of the gearbox is at hand, controlling operation of the fuel supply pump 241 so as to maintain fuel supply pump speed Prpm. The means being arranged for controlling operation of the fuel supply pump 241 so as to maintain fuel supply pump speed Prpm may comprise any one of the first control arrangement 200, the second control arrangement 210 and the device 500.

According to an example there is provided a system comprising means being arranged for, in case a gear step change of the gearbox is not at hand, allowing a change of fuel supply pump speed Prpm. The means being arranged to allow the change of fuel supply pump speed Prpm may comprise any one of the first control arrangement 200, the second control arrangement 210 and the device 500.

According to an example there is provided a system comprising means being arranged for determining a boost pressure Pb of the combustion engine system 250. The means being arranged for determining a boost pressure Pb may comprise any one of the first control arrangement 200, the second control arrangement 210, the device 500 and the boost pressure sensor 271.

According to an example there is provided a system comprising means being arranged for determining that a gear step change of the gearbox is at hand if the boost pressure Pb is unchanged over time. The means being arranged for determining that a gear step change of the gearbox is at hand may comprise any one of the first control arrangement 200, the second control arrangement 210 and the device 500.

According to an example there is provided a system comprising means being arranged for determining that a gear step change of the gearbox is not at hand if the boost pressure Pb is changed more than to a predetermined extent. The means being arranged for determining that a gear step change of the gearbox is not at hand may comprise any one of the first control arrangement 200, the second control arrangement 210 and the device 500.

According to an example there is provided a system comprising means being arranged for determining a Lambda-value λ of the combustion engine system 250. The means being arranged for determining a Lambda-value λ of the combustion engine system 250 may comprise any one of the first control arrangement 200, the second control arrangement 210, the device 500 and the Lambda-sensor configuration 261.

According to an example there is provided a system comprising means being arranged for determining that a gear step change of the gearbox is at hand if the Lambda-value λ is unchanged over time. The means being arranged for determining that a gear step change of the gearbox is at hand may comprise any one of the first control arrangement 200, the second control arrangement 210 and the device 500.

According to an example there is provided a system comprising means being arranged for determining that a gear step change of the gearbox is not at hand if the Lambda-value λ is changed more than to a predetermined extent. The means being arranged for determining that a gear step change of the gearbox is not at hand may comprise any one of the first control arrangement 200, the second control arrangement 210 and the device 500.

According to one example there is provided a vehicle comprising a system according to the disclosure herein.

Figure 2C:
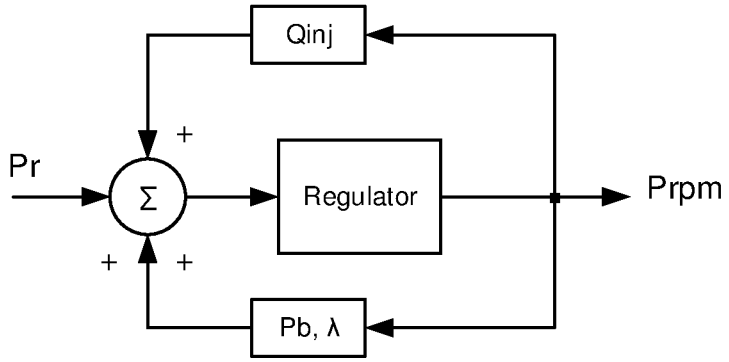
FIG. 2*c* schematically illustrates a signal scheme according to an embodiment of the invention.

FIG. 2*c* schematically illustrates a signal diagram according to an example embodiment.

The speed Prpm of the feeder pump 241 is operated on the basis of the fuel pressure Pr. A signal relating to the injected amount of fuel Qinj to the engine 250 is provided. Herein a regulator is arrange to provide the feeder pump speed signal on the basis of:

The boost pressure Pb only;

The Lambda-value λ only; or

Both the boost pressure Pb and the Lambda-value λ.

Figures 4A, 4B:
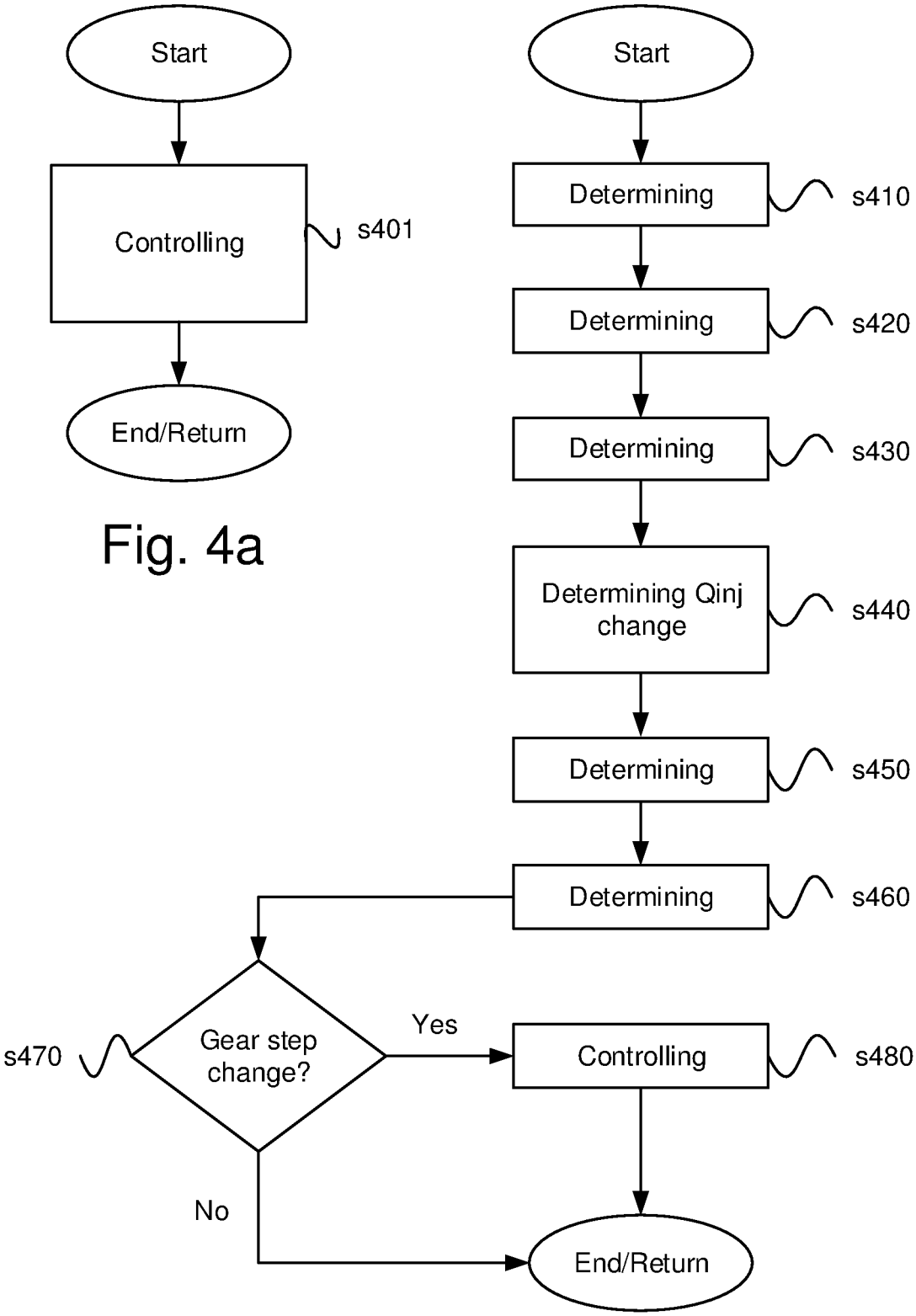
FIG. 4*a* is a schematic flowchart of a method according to an embodiment of the invention.
FIG. 4*b* is a schematic flowchart of a method according to an embodiment of the invention.

Functionality of the signal diagram is depicted in greater detail with reference to e.g. FIG. 4*b*.

Figure 3A:
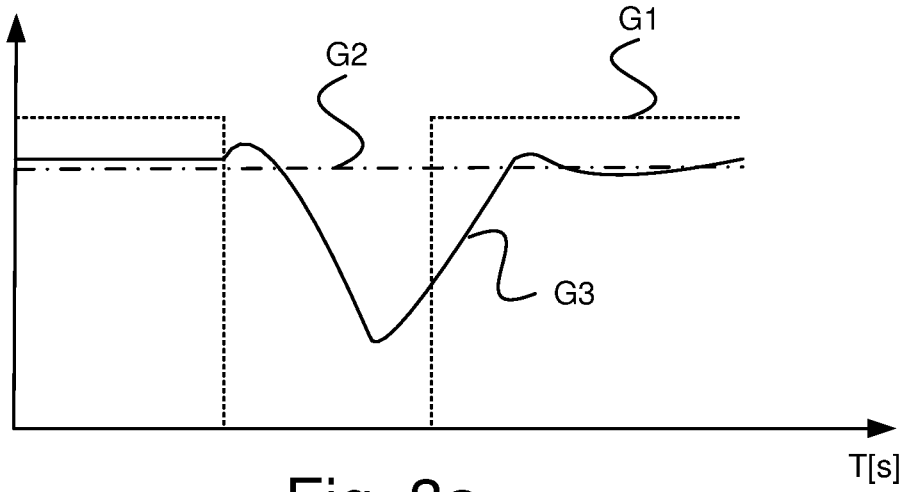
FIG. 3*a* schematically illustrates a diagram presenting actual fuel pressure of a fuel supply system.

FIG. 3*a* schematically illustrates a diagram wherein three parameters are given as a function of time T(s). FIG. 3*a* is relating to a case where the proposed method is not applied.

Injected amount of fuel Qinj is presented by a graph G1.

Nominal fuel pressure Pnom is presented by a graph G2.

Actual fuel pressure Pr is presented by a graph G3.

Herein it is illustrated that the actual fuel pressure Pr is at the same level as a desired nominal fuel pressure Pnom until fuel injection to the engine 250 is interrupted. The interruption of fuel injection may be caused by a process of changing gear-steps of the gearbox of the vehicle. Hereby the actual fuel pressure Pr is reduced according to control routines based on injected amount of fuel Qinj. At a point of time where the gear shifting process of the gearbox is completed the actual fuel pressure Pr is built up and later stabilized at a level of the nominal fuel pressure Pnom.

According to this control procedure an undesired drop of fuel pressure Pr is appearing during resuming of fuel provision after an interruption.

Figure 3B:
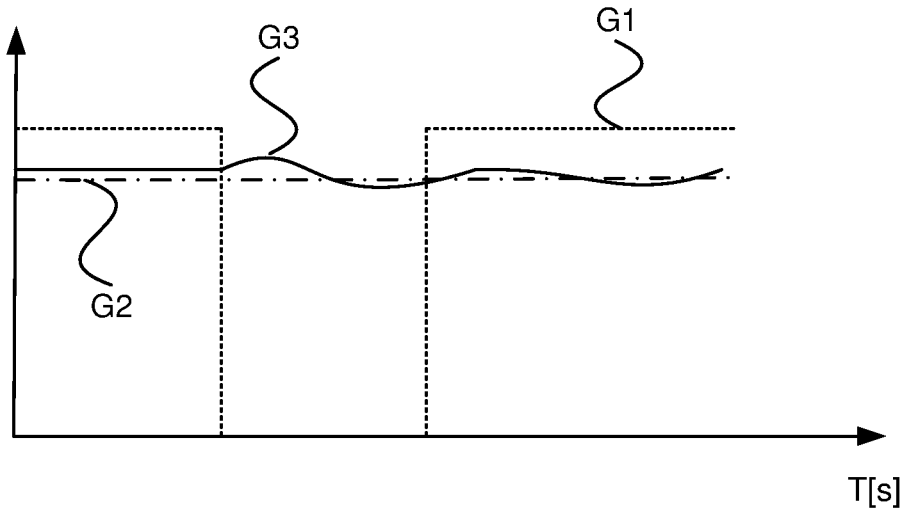
FIG. 3*b* schematically illustrates a diagram presenting actual fuel pressure of a fuel supply system according to an embodiment of the invention.

FIG. 3*b* schematically illustrates a diagram wherein the three parameters of FIG. 3*a* given as a function of time T(s), for comparison reasons. FIG. 3*b* is relating to a case where the proposed method is applied. Hereby values of at least one operational parameter of the combustion engine system is considered, namely the boost pressure Pb and the Lambda-value λ.

Injected amount of fuel Qinj is presented by a graph G1.

Nominal fuel pressure Pnom is presented by a graph G2.

Actual fuel pressure Pr is presented by a graph G3.

Herein it is illustrated that the actual fuel pressure Pr is substantially at the same level as a desired nominal fuel pressure Pnom until fuel injection to the engine 250 is interrupted. The interruption of fuel injection is hereby caused by a process of changing gear-steps of the gearbox of the vehicle. Hereby the actual fuel pressure Pr is only slightly deviating from the nominal fuel pressure Pnom. Control routines are hereby based on injected amount of fuel Qinj as well as boost pressure Pb and/or the Lambda-value λ (see e.g. FIG. 3*b* and FIG. 4*b*). At a point of time where the gear shifting process of the gearbox is completed, the actual fuel pressure Pr is advantageously already at a level of the nominal fuel pressure Pnom.

According to this control procedure, where the proposed method is applied, substantially no (undesired) drop of the fuel pressure Pr is appearing during fuel provision interruption.

FIG. 4*a* schematically illustrates a flow chart of a method for operating a fuel supply pump 241 of a vehicle 100. The vehicle 100 comprises a combustion engine system and a gearbox. The method comprises a method step s401. The method step s401 comprises the steps of:

determining values of at least one operational parameter of the combustion engine system;

determining a reduction of fuel a provision rate to the combustion engine system;

determining whether a gear step change of the gearbox is at hand, on the basis of the thus determined values of the at least one operational parameter; and in case a gear step change of the gearbox is at hand, controlling operation of the fuel supply pump 241 so as to maintain fuel supply pump speed Prpm.

The method steps of the step s401 may be performed continuously or intermittently.

After the method step s401 the method ends/is returned.

FIG. 4*b* schematically illustrates a flow chart of an exemplified embodiment of a method for operating a fuel supply pump 241 of a vehicle 100. According to one embodiment the method is activated upon detection of propulsion of the vehicle 100.

The method may comprise a method step s410. The method step s410 comprises the step of determining a prevailing fuel pressure Pr. This may be performed by means of a fuel pressure sensor 243. The step of determining a prevailing fuel pressure Pr may be performed continuously or intermittently. After the method step s410 a subsequent method step s420 may be performed.

The method step s420 may comprise the step of determining a boost pressure Pb provided by a turbo charger unit of the engine 250. The turbo charger unit may also be denoted turbo arrangement. The boost pressure Pb may alternatively be denoted charge air pressure. The boost pressure Pb may be determined continuously or intermittently. The boost pressure Pb may be determined by means of the boost pressure sensor 271. The method step s420 may comprise the step of determining values of at least one operational parameter of the combustion engine system, wherein the operational parameter is the boost pressure Pb. According to one example, wherein the combustion engine system does not comprise a turbo charger unit, the method step s420 is not performed. Hereby the proposed method is performed on the basis of a determined prevailing Lambda-value λ (see step s430). After the method step s420 a subsequent method step s430 may be performed.

The method step s430 may comprise the step of determining a prevailing Lambda-value λ. The Lambda-value λ may be determined continuously or intermittently. The Lambda-value λ may be determined by means of the Lambda-sensor arrangement 261 and the first control arrangement 200. The method step s430 may comprise the step of determining values of at least one operational parameter of the combustion engine system, wherein the operational parameter is the Lambda-value λ. After the method step s430 a subsequent method step s440 may be performed.

The method step s440 may comprise the step of determining a change of injected amount of fuel Qinj to the engine 250. The step of determining a change of injected amount of fuel Qinj may comprise the step of determining if a fuel provision rate is reduced. According to one example a change is determined if a fuel provision rate is reduced by at least 50% from a prevailing fuel provision rate. According to one example a change is determined if a fuel provision rate is reduced by at least 90% from a prevailing fuel provision rate. According to one example a change is determined if fuel provision is reduced to zero (that is, interrupted). This can be performed by means of the first control arrangement 200. The method step s440 may comprise the step of determining a change of fuel provision to the combustion engine system. After the method step s440 a subsequent method step s450 may be performed.

The method step s450 may comprise the step of determining if the thus determined boost pressure Pb is unchanged, given that a change of injected amount of fuel Qinj has been determined. The thus determined boost pressure Pb is hereby maintained at a constant level over time when the injected amount of fuel Qinj is changed. The thus determined boost pressure Pb is hereby maintained at a constant level over time when the injected amount of fuel Qinj per second is significantly reduced, e.g. by 90% or more. If the boost pressure Pb is changed by more than to a predetermined extent, e.g. 10%, 25% or 50%, it is determined that the boost pressure Pr is not unchanged. The step s450 may be performed by means of the first control arrangement 200. After the method step s450 a subsequent method step s460 may be performed.

The method step s460 may comprise the step of determining if the thus determined Lambda-values λ are unchanged, given that a change of injected amount of fuel Qinj has been determined. The thus determined Lambda-values λ are hereby maintained at a constant level over time when the injected amount of fuel Qinj is changed. The thus determined Lambda-values λ are hereby maintained at a constant level over time when the injected amount of fuel Qinj per second is significantly reduced, e.g. by 90% or more. If the Lambda-values λ are changed by more than to a predetermined extent, e.g. 10%, 25% or 50%, it is determined that the Lambda-value λ is not unchanged. The step s460 may be performed by means of the first control arrangement 200. After the method step s460 a subsequent method step s470 may be performed.

The method step s470 may comprise the step of determining whether a gear-step change of the gearbox of the vehicle is at hand. This may be performed by means of the first control arrangement 200.

The method step s470 may comprise the step of determining whether a gear step change of the gearbox is at hand, on the basis of the thus determined values Pb and λ of the at least one operational parameter.

The method step s470 may comprise the step of determining that a gear step change of the gearbox is at hand if the boost pressure Pb is unchanged over time.

The method step s470 may comprise the step of determining that a gear step change of the gearbox is not at hand if the boost pressure Pb is changed more than to a predetermined extent.

The method step s470 may comprise the step of determining that a gear step change of the gearbox is at hand if the Lambda-value λ is unchanged over time.

The method step s470 may comprise the step of determining s470 that a gear step change of the gearbox is not at hand if the Lambda-value λ is changed more than to a predetermined extent.

If it is determined that gear step change of the gearbox is at hand a subsequent step s480 may be performed.

If it is determined that a gear step change of the gearbox is not at hand a change of fuel supply pump speed Prpm is allowed.

The method step s480 may comprise the step of controlling operation of the fuel supply pump 241 so as to maintain fuel supply pump speed Prpm at a current/prevailing level. The method step s480 may comprise the step of controlling operation of the fuel supply pump 241 so as to maintain fuel supply pump speed Prpm. Hereby the actual fuel pressure Pr is maintained at a level of the nominal fuel pressure Pnom (see FIG. 3*b*).

In case a gear step change of the gearbox is not at hand the fuel supply pump speed Prpm may be controlled according to stored routines. Hereby operation of the feeder pump 241 may be controlled on the basis of the prevailing fuel pressure Pr such that the feeder pump speed Prpm is reduced accordingly if the prevailing fuel pressure Pr is reduced.

After the method step s480 the method ends/is returned.

Figure 5:
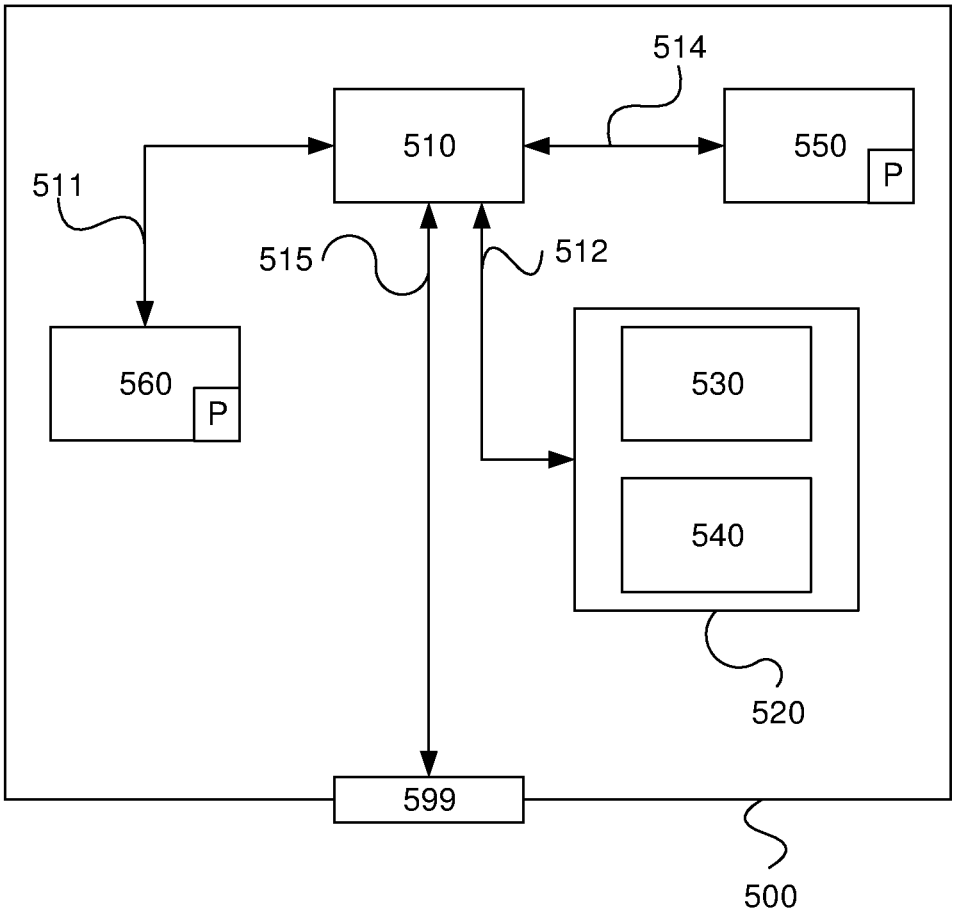
FIG. 5 schematically illustrates a computer according to an embodiment of the invention.

FIG. 5 is a diagram of one version of a device 500. The control arrangements 200 and 210 described with reference to FIG. 2 may in one version comprise the device 500. The device 500 comprises a non-volatile memory 520, a data processing unit 510 and a read/write memory 550. The non-volatile memory 520 has a first memory element 530 in which a computer program, e.g. an operating system, is stored for controlling the function of the device 500. The device 500 further comprises a bus controller, a serial communication port, I/O means, an A/D converter, a time and date input and transfer unit, an event counter and an interruption controller (not depicted). The non-volatile memory 520 has also a second memory element 540.

The computer program P comprises routines for operating a fuel supply pump 241 of the vehicle 100.

The computer program P may comprise routines for determining values of at least one operational parameter of the combustion engine system.

The computer program P may comprise routines for determining a change of fuel provision to the combustion engine system.

The computer program P may comprise routines for determining whether a gear step change of the gearbox is at hand, on the basis of the thus determined values of the at least one operational parameter.

The computer program P may comprise routines for, in case a gear step change of the gearbox is at hand, controlling operation of the fuel supply pump so as to maintain fuel supply pump speed Prpm.

The computer program P may comprise routines for, in case a gear step change of the gearbox is not at hand, allowing a change of fuel supply pump speed Prpm.

The computer program P may comprise routines for determining a boost pressure Pb of the combustion engine system and determining that a gear step change of the gearbox is at hand if the boost pressure Pb is unchanged over time.

The computer program P may comprise routines for determining a boost pressure Pb of the combustion engine system and determining that a gear step change of the gearbox is not at hand if the boost pressure Pb is changed more than to a predetermined extent.

The computer program P may comprise routines for determining a Lambda-value λ of the combustion engine system and determining that a gear step change of the gearbox is at hand if the Lambda-value λ is unchanged over time.

The computer program P may comprise routines for determining a Lambda-value λ of the combustion engine system and determining that a gear step change of the gearbox is not at hand if the Lambda-value λ is changed more than to a predetermined extent.

The computer program P may comprise routines for performing any one of the process steps detailed with reference to the disclosure.

The program P may be stored in an executable form or in compressed form in a memory 560 and/or in a read/write memory 550.

Where it is stated that the data processing unit 510 performs a certain function, it means that it conducts a certain part of the program which is stored in the memory 560 or a certain part of the program which is stored in the read/write memory 550.

The data processing device 510 can communicate with a data port 599 via a data bus 515. The non-volatile memory 520 is intended for communication with the data processing unit 510 via a data bus 512. The separate memory 560 is intended to communicate with the data processing unit via a data bus 511. The read/write memory 550 is arranged to communicate with the data processing unit 510 via a data bus 514. The links L210, L231, L241, L243, L261 and L271, for example, may be connected to the data port 599 (see FIGS. 2*a* and 2*b*).

When data are received on the data port 599, they are stored temporarily in the second memory element 540. When input data received have been temporarily stored, the data processing unit 510 will be prepared to conduct code execution as described above.

Parts of the methods herein described may be conducted by the device 500 by means of the data processing unit 510 which runs the program stored in the memory 560 or the read/write memory 550. When the device 500 runs the program, method steps and process steps herein described are executed.

The foregoing description of the preferred embodiments of the present invention is provided for illustrative and descriptive purposes. It is not intended to be exhaustive, nor to limit the invention to the variants described. Many modifications and variations will obviously suggest themselves to one skilled in the art. The embodiments have been chosen and described in order to best explain the principles of the invention and their practical applications and thereby make it possible for one skilled in the art to understand the invention for different embodiments and with the various modifications appropriate to the intended use.

The invention claimed is:

1. A method for operating a fuel supply pump of a vehicle, the vehicle comprising a combustion engine system and a gearbox, the method comprising the steps of:

determining one or more operational values of at least one operational parameter of the combustion engine system;

determining a reduction of a fuel provision rate to the combustion engine system;

determining whether a gear step change of the gearbox is at hand, on the basis of the determined one or more operational values of the at least one operational parameter; and in case a gear step change of the gearbox is at hand, controlling operation of the fuel supply pump so as to maintain fuel supply pump speed.

2. The method according to claim 1, comprising the step of:

in case a gear step change of the gearbox is not at hand, allowing a change of fuel supply pump speed.

3. The method according to claim 1, wherein the determined one or more operational values is a boost pressure of the combustion engine system, and wherein determining whether a gear step change of the gearbox is at hand comprises determining that a gear step change of the gearbox is at hand if the boost pressure is unchanged over time.

4. The method according to claim 1, wherein determining the determined one or more operational values is a boost pressure of the combustion engine system, and wherein determining whether a gear step change of the gearbox is at hand comprises determining that a gear step change of the gearbox is not at hand if the boost pressure is changed more than to a predetermined extent.

5. The method according to claim 1, wherein the determined one or more operational values is a Lambda-value of the combustion engine system, and wherein determining whether a gear step change of the gearbox is at hand comprises determining that a gear step change of the gearbox is at hand if the Lambda-value is unchanged over time.

6. The method according to claim 1, wherein the determined one or more operational values is a Lambda-value of the combustion engine system, and wherein determining whether a gear step change of the gearbox is at hand comprises determining that a gear step change of the gearbox is not at hand if the Lambda-value is changed more than to a predetermined extent.

7. A system for operating a fuel supply pump of a vehicle, the vehicle comprising a combustion engine system and a gearbox, the system comprises:

means being arranged for determining one or more operational values of at least one operational parameter of the combustion engine system;

means being arranged for determining a reduction of a fuel provision rate to the combustion engine system;

means being arranged for determining whether a gear step change of the gearbox is at hand, on the basis of the determined one or more operational values of the at least one operational parameter; and means being arranged for, in case a gear step change of the gearbox is at hand, controlling operation of the fuel supply pump so as to maintain fuel supply pump speed.

8. The system according to claim 7, the system comprising:

means being arranged for, in case a gear step change of the gearbox is not at hand, allowing a change of fuel supply pump speed.

9. The system according to claim 7, wherein the determined one or more operational values is a boost pressure of the combustion engine system, and wherein said means for determining whether a gear step change of the gearbox is at hand comprises means being arranged for determining that a gear step change of the gearbox is at hand if the boost pressure is unchanged over time.

10. The system according to claim 7, wherein the determined one or more operational values is a boost pressure of the combustion engine system, and wherein said means for determining whether a gear step change of the gearbox is at hand comprises means being arranged for determining that a gear step change of the gearbox is not at hand if the boost pressure is changed more than to a predetermined extent.

11. The system according to claim 7, wherein the determined one or more operational values is a Lambda-value of the combustion engine system, and wherein said means for determining whether a gear step change of the gearbox is at hand comprises means being arranged for determining that a gear step change of the gearbox is at hand if the Lambda-value is unchanged over time.

12. The system according to claim 7, wherein the determined one or more operational values is a Lambda-value of the combustion engine system, and wherein said means for determining whether a gear step change of the gearbox is at hand comprises means being arranged for determining that a gear step change of the gearbox is not at hand if the Lambda-value is changed more than to a predetermined extent.

13. A vehicle comprising a system for operating a fuel supply pump of a vehicle, the vehicle comprising a combustion engine system and a gearbox, the system comprises:

means being arranged for determining one or more operational values of at least one operational parameter of the combustion engine system;

means being arranged for determining a reduction of a fuel provision rate to the combustion engine system;

means being arranged for determining whether a gear step change of the gearbox is at hand, on the basis of the determined one or more operational values of the at least one operational parameter; and means being arranged for, in case a gear step change of the gearbox is at hand, controlling operation of the fuel supply pump so as to maintain fuel supply pump speed.

14. A non-transitory computer readable media comprising program instructions stored thereon for operating a fuel supply pump of a vehicle, the vehicle comprising a combustion engine system and a gearbox, said computer program instructions configured to cause one or more computing devices to perform the following operations:

determine one or more operational values of at least one operational parameter of the combustion engine system;

determine a reduction of a fuel provision rate to the combustion engine system;

determine whether a gear step change of the gearbox is at hand, on the basis of the determined one or more operational values of the at least one operational parameter; and in case a gear step change of the gearbox is at hand, control operation of the fuel supply pump so as to maintain fuel supply pump speed.

* * * * *